US008621771B2

(12) United States Patent
Amalaha

(10) Patent No.: US 8,621,771 B2
(45) Date of Patent: Jan. 7, 2014

(54) MACHINE FOR CONTROLLABLY FLYING A FLAG IN THE ABSENCE OF NATURAL WIND

(76) Inventor: Leonard Dozie Amalaha, Alexandria, VA (US)

( * ) Notice: Subject to any disclaimer, the term of this patent is extended or adjusted under 35 U.S.C. 154(b) by 549 days.

(21) Appl. No.: 12/589,559

(22) Filed: Oct. 26, 2009

(65) Prior Publication Data

US 2011/0094133 A1 Apr. 28, 2011

(51) Int. Cl.
*G09F 17/00* (2006.01)

(52) U.S. Cl.
USPC ..... 40/218; 116/173

(58) Field of Classification Search
USPC ..... 40/218; 116/173, 174
See application file for complete search history.

(56) References Cited

U.S. PATENT DOCUMENTS 2,122,766 A * 7/1938 Wiemer ..... 40/215
5,692,328 A * 12/1997 Pettit ..... 40/218
7,017,510 B1 * 3/2006 Nair ..... 116/173

* cited by examiner

*Primary Examiner* — Joanne Silbermann

(57) ABSTRACT

A machine for controllably flying a flag indoors or outdoors in the absence of natural wind; said machine constituted of a base member having enough depth to house and protect electronic and/or electro-mechanical drive components etc.; said drive components including, but not limited to at least one electric motor mechanically coupled to a drive shaft of a cylindrical centrifugal fan via pulleys; said fan, as well as an air foil member and a flag pole housed in a long tubular wind pipe rigidly secured atop aforementioned base member in such a manner that when the aforesaid motor(s) actuates the aforesaid fan member via the aforesaid shaft, air pulled in through holes on the wind pipe is blown past the aforesaid airfoil, and then past the flagpole and attached flag, thereby causing said flag to rise and flap in the natural manner; an airfoil angle of attack knob atop the aforementioned wind pipe, in conjunction with a motor speed control knob atop the aforementioned base member, providing affective means of changing or modifying the flying pattern or flapping of aforesaid flag; a synthesized music circuit consisting of several songs preferably national anthems or state songs programmed into its memory is looped together with a programmable timer and an LCD display and control panel for permitting timed actuations of the machine ala electronic alarms.

19 Claims, 8 Drawing Sheets

MACHINE FOR CONTROLLABLY FLYING A FLAG IN THE ABSENCE OF NATURAL WIND

SUMMARY OF THE INVENTION

This invention discloses a means of flying a flag in the absence of natural wind. The means for producing wind is achieved by a long body centrifugal fan having a long shaft which is driveably coupled to a motor in the enclosure housing of the base member. An airfoil member confronting the fan permits the change of angle of attack of the air blown past a long flag pole and an attached flag at its upper portion thereof, thereby changing the way the flag flies. The angle of attack of the airfoil is changed by turning a knob atop the wind pipe housing which encloses the fan, the airfoil and flag pole. A motor speed control potentiometer type knob is mounted atop the base member and allow variation of motor speed and hence the amount of air the fan can blow past the flag, thereby helping to modify the flag's behavior as well. Adjusting the angle of attack via the knob can result in balance or unbalancing of the aerodynamic forces acting on either side of the flag in such a manner as to cause it to fly straight, lean, sway gently or develop a unique flapping pattern, or a combination of the above attitudes.

This invention can be used indoors or outdoors. The indoors version can be placed on a night stand in a bedroom, an office table or any suitable flat surface. The outdoors version can be mounted on a concrete base with large bolts and having a windpipe about the height of standard street flag poles. The main difference between the two types is that owing to the great height of the outdoors version's pole, angle of attack adjustments is achieved via two different methods. The first method employs a hand crank mounted atop the base and coupled to the shaft of the airfoil via gears. The second method employs a stepper motor mounted atop aforesaid base and coupled mechanically to the airfoil shaft via gears. This motor may be remotely operated as well.

In another embodiment of this invention, the electronic circuit includes in addition to the motor circuit, an automatic battery charging circuit which permits A/C power charging via an adapter, a digital timing circuit for setting actuation times which are displayed on an LCD screen mounted on the lower edge of the wind pipe or atop the base, and a microcomputer chip controlled musical tunes generating circuit; said musical tunes pre-programmed in the chip's memory, selectable and preferably several national anthems of several countries and/or popular state adopted or nationally popular songs. Examples of such songs may include, but not limited to 'Living in America' by James Brown, 'Georgia on My Mind' by Ray Charles, 'God Bless the USA/Proud to be an American' by Lee Greenwood, 'West Virginia/Take Me Home Country Roads' by John Denver, etc. The electrical/electronic arrangement may be such that the sequential actuation of the flag and the music constitute an alarm system that can be programmed to come on at a predetermined time and play one or more songs before the duration settings in the control chip's memory cuts it out.

In yet another embodiment of this invention, the drive motor in the base drives the fan shaft directly via bevel gears, thereby reducing the number of the moving parts. However, direct drive gear systems are naturally inherently noisier than belt driven systems and may therefore be suitable for the outdoor's version.

In one more embodiment of this invention, a pivoting lamp and a control switch are mounted atop the base. The switch is an on/off switch which when in the ON position, allows the light to come on together with the actuation of the flag or on its own, while illuminating the flag in each case.

Still another embodiment of this invention provides a means for 'secure hold' of an angle of attack selected via the knob from being changed by aerodynamic lift coefficient forces acting on the airfoil; said 'secure hold' means consisting of a spring loaded position selector pin movably attached to the lower end of the airfoil shaft via a hole thru said shaft such that a grooved stator arrestingly permits several positions to be selected.

In one last, but not least embodiment of this invention, a method is presented for rigidly coupling a drive shaft to a cylindrical centrifugal fan without welding and/or screws. The shaft and fan arrangement according to my teachings permits stacking of several fans which may be rigidly and quickly riveted together such that the resultant long stacked fan array is considerably stronger than a single long fan. This arrangement is necessary to reduce unwanted fan oscillations in large long length systems. These fans can be molded out of plastics in the conventional manner or made of metals such as steel or aluminum. Two blade configurations are presented, namely inwardly and outwardly canted blades. Fan end shaft coupling holes have at least one flat side, half moon shape to match and tightly fit the drive shaft which is rigidly coupled to the fan's end flanges by means of C or E clips for quick assembly and disassembly.

DETAILED DESCRIPTION OF THE DRAWINGS

Figures 1, 2:
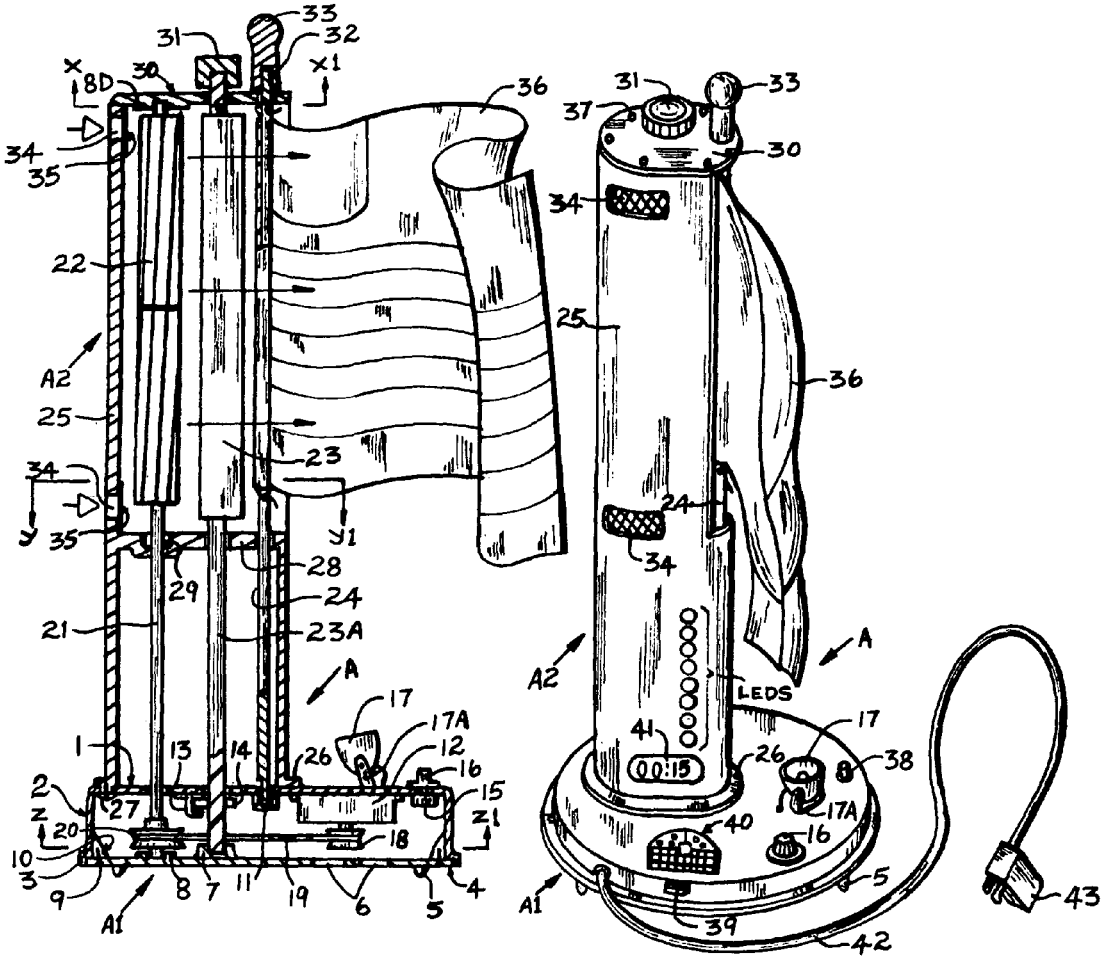
FIG. 1 is a perspective view of a machine for controllably flying a flag in the absence of natural wind.
FIG. 2 is a cross-sectional view of the machine shown in FIG. 1

Referring to FIG. 1, the machine for flying a flag in the absence of natural wind A has a base member A1 and a wind pipe A2. The base member A1 has a top mounted lamp 17 pivotably mounted on a mounting bracket 17A and a lamp switch 38 for turning on the lamp if desired, for illuminating the flag 36. There is a motor speed control knob 16 for adjusting motor speed. 40 represents the electronic control panel while 41 represents the LCD panel mounted above the flange 26 of the wind pipe 25. The pipe 25 is provided with air vents 34 from which the fan sucks in air. The top cover 30 of the wind pipe 25 is held in place by screws 37. The angle of attack knob is represented by 31 while 33 represents the crown of the flag pole 24 which retains the flag 36. The base A1 is provided with short legs 5 which gives it clearance from the ground so that sound waves from the speaker as well as heat dissipation from vent holes can emanate therefrom. 39 represents the power ON/OFF switch. An A/C adapter 43 and power chord 42 are used to supply power from the mains to the unit.

Referring now to FIG. 2, the machine for flying a flag in the absence of natural wind A, has a base member A1 atop of which is mounted, a wind pipe A2. The said wind pipe A2 is provided with a dividing/reinforcing wall 28 and a lower edge flange 26 for coupling to the top flat wall 1 of the aforesaid base member A1 which forms into a tubular wall housing 2 and a lower edge flange 3. Integrally molded or machined studs 10 permit a cover plate 4 to be rigidly secured to the aforesaid edge flange 3 by means of screws 9. By means of screws 27 the wind pipe A2 is rigidly secured atop the base member A1. The bottom cover 4 is preferably molded out of plastic materials such as nylon which would be advantageous to the shafts 21 and 23A which respectively are coupled to the fan 22 and the airfoil 23 and rotate in their respective holes on the raised annular ledges 8 and 7. By means of pulleys 18 and 20 and belt 19, the motor 12 is coupled to the fan shaft 21. The bottom cover 4 has integrally molded legs 5 and is provided as well with vent holes 6. A short tube 11 protrudes into the base and has a half moon shape. The matching splined lower edge of the flag pole 24 sits inside said tube 11, thereby steadying the pole and negating torsional divergence (twisting torque) resulting from the force of the air from the fan. The threaded upper edge 32 is coupled to the crown 33 by means of matching threading and/or bonding with a suitable bonding agent. The flag pole 24 is dropped in from the top thru a hole on the top cover 30, thru a second hole on the dividing wall 28 of the wind pipe A2 such that the lower edge sits inside the tube 11. The potentiometer 15 is mounted on the inside of the top surface 1 of the base while the adjusting knob 16 sits on top. The lamp 17 is pivotably mounted on top of the base as well by means of the bracket 17A. Atop the cover 30 of the wind pipe A2 sits the angle of attack knob 31 coupled to the shaft 23A by means of threading. This allows the knob 31 to be easily screwed on or unscrewed during assembly or disassembly. The shaft 23A passes thru a hole on the cover 30, thru a second hole on the dividing wall 28, thru a third hole on the top surface 1 of the base A1 and into the matching hole on the raised ledge 7 of the bottom cover 4. The shaft 23A is rigidly bonded to the airfoil 23 by means of a suitable bonding agent such as epoxy resins. The fan 22 is rigidly coupled to the shaft 21 and positioned such that it confronts the airfoil 23. The upper end of the shaft 21 is rotatably connected to a matching hole on the raised annular ledge 8D of the cover 30 which is preferable made of nylon and serves as a bearing. The shaft 21 also passes thru a ball bearing 29 located in a matching recess on the dividing wall 28, thru a hole on the top surface 1 of the base A1, thru the pulley which it is rigidly coupled to and into a matching hole on the annular raised ledge 8 of the bottom cover 4 which is preferably molded out of nylon and serves as a bearing. An arrest means 13 mounted under the top surface 1 of the base A1 is provided with a spring loaded pin 14, which goes thru a hole in the shaft 23A such that it permits selectable adjustments of the angle of attack via the top mounted knob 31. The wind pipe A2 is provided with air suction holes 34 which are preferably located about the ends of the fan 22; said air suction holes having integrally molded mesh 35 to keep fingers from reaching the rotating blades of the fan 22. During operation, air is sucked into the wind pipe A2 via the suction holes 34 by the fan 22 and blown at the airfoil 23 which by Coanda effect permits air to be blown past the flag 36 which rises and flies in a controlled determinable manner. The flag 36 is preferably made of silk or stretch fabrics. However, other materials that are not stiff may be employed. The ends of the fan shaft 21 may be coupled to ball bearings located on covers 4 and 30 respectively.

Figure 3:
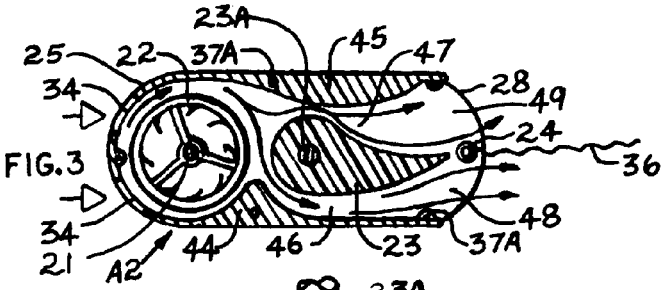
FIG. 3 is a sectional view taken along line Y-Y1 of FIG. 2 to show movement of air around airfoil by coanda effect.

Referring now to FIG. 3 which is taken along line Y-Y1 of FIG. 1, the wind pipe A2 is provided with air suction holes 34 for the fan 22 which is coupled to the shaft 21. The solid body 25 of the wind pipe A2 is also provided with mounting holes 37A for the top cover 30 shown in FIG. 1. The solid body 25 is preferably molded out of plastic materials like PVC, ABS, Delrin or the like, or cast out of aluminum or stamped steel. The shaft 22 of the airfoil 23 positions it in such a manner that its leading edge confronts the fan 22 and its trailing edge confronts the flag pole 24 and attached flag 36 in the neutral position. The fan 22 is placed very close to an inwardly extending protuberance wall section 44 and away from a gently tapered opposite inner wall 45. The arrangement creates throats 46 and 47 on either side of the leading edge of the airfoil 23 and exit mouths 48 and 49 respectively on either side of the trailing edge of said airfoil 23. In operation, clockwise rotation of the fan 22 causes air to be drawn in thru the air holes 34 and blown at the leading edge of the airfoil 23. By coanda effect, the air accelerates under increased pressure at the throats 46 and 47 respectively, hugs the curvature of the airfoil 23 and exit the mouths 48 and 49, thereby causing the flag 36 to rise. The airfoil 23 which is essentially a phase plug, depending on a selected angle of attack can balance or unbalance the air loads acting on either side of the flag 36 thereby permitting the manipulation of its attitude in the wind. 28 represents the centrally located dividing/reinforcing wall.

Figure 4:
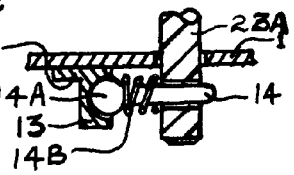
FIG. 4 is a sectional view of the angle of attach selection mechanism.

In reference to FIG. 4, the angle of attack selection mechanism is provided with a tensioner body 13 having a mounting flange 13A and mounted under the top surface 1 of the base. The shaft 23A is passed thru a hole on the said top surface 1 of the base. A retaining pin 14 passes thru a hole on the shaft 23A and is provided with a ball shaped head 14A which under tension of the spring 14B arrestingly retains a selected angle of attack such that the aerodynamic lift forces acting on the airfoil 23 (FIG. 3) don't change it.

Figure 5:
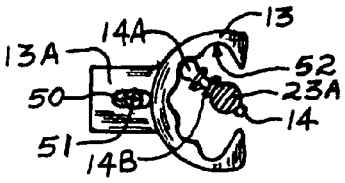
FIG. 5 is a top plan view of the angle of attack selection mechanism depicted in FIG. 4.

In reference to FIG. 5, the airfoil shaft is represented by 22 while 14 represents the retaining pin provided with a ball shaped head 14A under the tension of the spring 14B. The tensioner body is represented by 13 and is provided with selector position grooves 52 and a mounting flange 13A; said mounting flange having a slot 50 and held in place by a screw 51.

Figure 6:
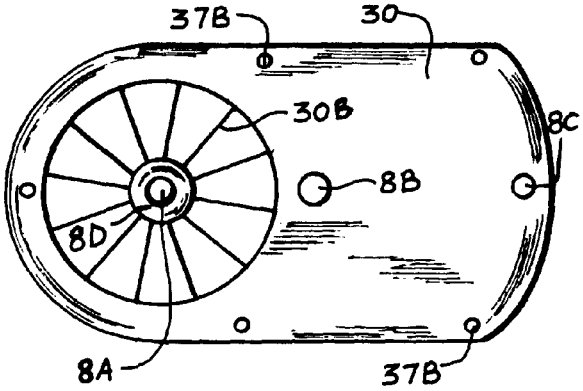
FIG. 6 is a view of the inner face of the top cover of the wind pipe depicted in FIG. 2 and taken along line X-X1.

Now referring to FIG. 6, the top cover of the wind pipe is represented by 30. It is provided with an annular raised ledge 8D having a hole 8A for accepting the fan shaft 21 shown in FIG. 2. The mounting holes are represented by 37B. The airfoil shaft 23A and flag pole 24 respectively pass thru the holes 8B and 8C.

Figures 7, 8:
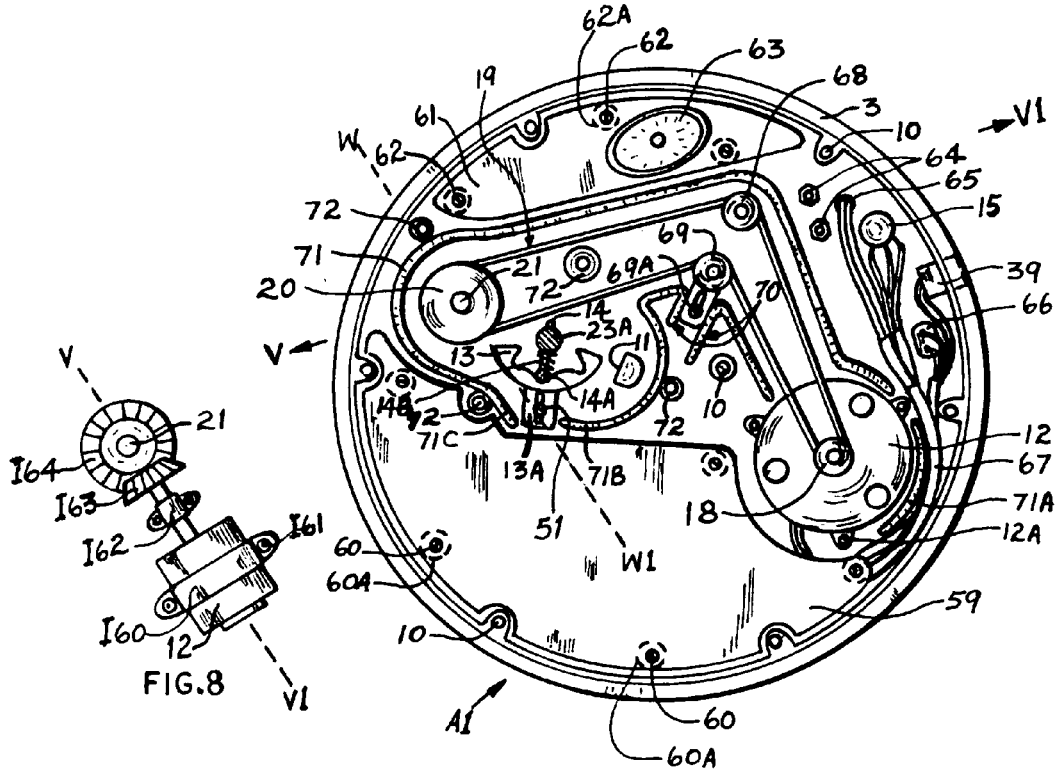
FIG. 7 is a view into the base member of the flag flying machine depicted in FIG. 2 and taken along line Z-Z1.
FIG. 8 is a perspective view of another embodiment of this invention showing a direct drive arrangement of the fan shaft shown in FIG. 7, employing bevel gears and located along line V-V1.

Now referring to FIG. 7 which is a view into the base from the bottom, with the cover removed and taken along line Z-Z1 of FIG. 2. The drive motor 12 is mounted as shown with screws 12A. The motor pulley 18 is driveably connected to the fan shaft 21 and pulley 20 by means of a serpentine belt 19 which connects two other pulleys mounted in the conventional manner. The one pulley 68 is permanently set while the other pulley 69 is a conventional static slot type tensioner which is slideably adjustable between raised walls 70 and set with the screw 69A. The belt 19 is surrounded by the raised wall 71 with breaks at terminate ends 71B and 71C to create an opening for the mounting flange 13A of the tensioner body 13 of the angle of attack selection mechanism. There is a mounting screw 51 in a slot and a retaining pin 14 having a ball shaped head 14A. Pin 14 passes thru a hole on the angle of attack shaft 23A and held thereon by the spring 14B such that the ball shaped head 14A sits in grooved sections of the tensioner body 13, thereby permitting different angle of attack selections to be made. 61 represent an auxiliary circuit board unto which the speaker 63 may be mounted by means of bonding agents or screws. It is mounted on studs 62A by means of screws 62. The screws 64 hold the lamp and brackets on the opposite side. The cables from the lamp are passed thru a hole 65 to the main circuit board 59. Wires 67 from the potentiometer 15 and the ON/OFF switches 39 and 66 are passed between the wall 71A which partially surrounds the motor 12 and the inner diametrical wall of the edge flange 3 to the main circuit board 59 which is mounted on studs 60A by means of screws 60. A battery compartment (not shown) is positioned underneath the main circuit board 59. The securing screw on the pulley 20 (see FIG. 20) may be tightened or removed by employing a screw driver along the axis W-W1. The studs 72 aid in rigidly coupling the wind pipe (FIG. 2) to the base. The bottom cover is attached to the base using the threaded studs 10. The flag pole's lower edge sits inside the half moon shaped tube 11 to keep it from making radial movements during operation. The use of a serpentine belt drive system results in quiet operation. In the event that the belt 19 should break while in operation, the surrounding wall 71 provides containment and prevents damage to other system components housed in the base A1.

In reference to FIG. 8, the arrangement shown, as an alternate gear coupled direct drive system can be located along line V-V1 axis of FIG. 7. The motor is represented by 12 and mounted with a strap 160 and bolts 161. The motor shaft is preferably coupled to a bearing 162 and a bevel gear 163; said bevel gear 163 directly and rotatably connected to a second bevel gear 164 rigidly attached to the fan shaft 21. Even though smooth V groove pulley and belt systems as well as direct drive gear systems are depicted, this in no way limits the scope of the drive systems possible. Toothed belts and matching sprocket pulley (timing) arrangements are possible. Also the fan shaft can be driven directly by the motor.

Figure 9:
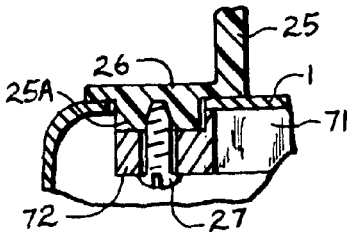
FIG. 9 is a sectional view showing the method of coupling the flange of the wind pipe to the top of the base member.

In reference to FIG. 9, the solid body wall 25 of the wind pipe terminates into an edge flange 26 provided with short threaded studs 25A for coupling with matching unthreaded hole studs 72. The studs 72 are integrally molded with belt surrounding raised wall 71 and top base surface 1 such that both entities are rigidly held together by the screws 27.

Figure 10:
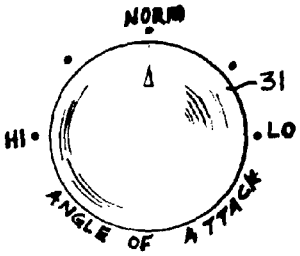
FIG. 10 is a top view of the angle of attack knob shown in FIG. 1, showing adjustment markings.

Referring now to FIG. 10, the angle of attack knob 31 shows that adjustments from low to high are possible.

Figure 11:
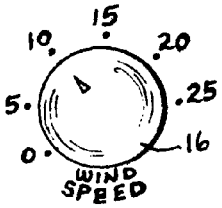
FIG. 11 is a top view of the motor speed control knob shown in FIG. 1, showing adjustment markings.

Referring now to FIG. 11, the motor speed control knob 16 (potentiometer) shows possible adjustment markings.

Figure 12:
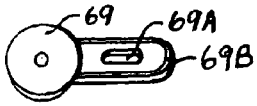
FIG. 12 is a perspective view of a conventional static slot tensioner used to tension the drive belt of this invention.

In reference to FIG. 12, the conventional static slot tensioner has a freely rotating pulley 69, a coupling flange 69B and a racetrack type slot 69A.

Figure 13:
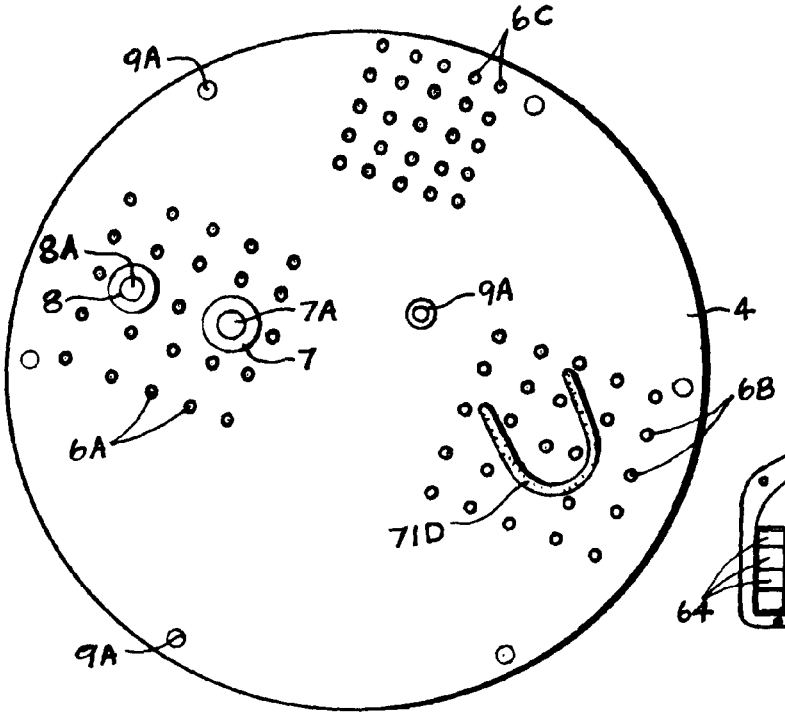
FIG. 13 is a view of the inner face of the bottom cover of the base member shown in FIG. 2.

In reference to FIG. 13, the bottom cover plate 4 for the base A1 of FIG. 7 shows the configuration of the inner face. It is provided with raised annular ledges 7 and 8 respectively provided with non thru holes 7A and 8A which serve as bearings for the respective shafts of the airfoil and fan. The adjoining perforations 6A are for air circulation to the bearings and shafts. The perforations 6B circulate air to the motor. The raised wall 71D surround the motor pulley 18 and a portion of the belt 19 (see FIG. 7). The perforations 6C confront the speaker for enhancing audio outputs. The holes 9A are mounting holes.

Figure 14:
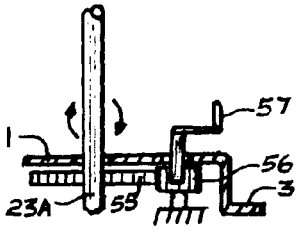
FIG. 14 is a sectional view of another embodiment of this invention depicting a hand crank method for modifying angle of attack on the outdoors model.

Now referring to FIG. 14, the airfoil shaft 23A is coupled to a drive gear 55 which meshes with a static gear 56 connected to a hand crank 57 set above the base surface 1 provided with an edge flange 3. The hand crank 57 permits manual adjustments of the angle of attack of the airfoil in outdoor systems.

Figure 15:
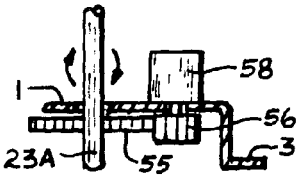
FIG. 15 is a sectional view of another embodiment of this invention depicting an angle of attack modifying means for the outdoors model, employing a stepper motor.

Now referring to FIG. 15, the airfoil shaft 23A is coupled to drive gear 55 which meshes with a static gear 56 which is directly coupled to a stepper drive motor 58 which is mounted atop the base surface 1 provided with an edge flange 3. The motor 58 may be operated by remote control or by switches placed atop the surface 1 thereby permitting motorized adjustments of the angle of attack of the airfoil in indoor or outdoor systems. The motor 58 may also be mounted within the base with the gears 55 and 56.

Figure 15A:
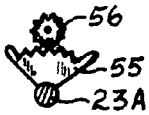
FIG. 15A is a top cross-sectional view of the gear arrangements shown in FIG. 14 or FIG. 15.

In reference to FIG. 15A, the airfoil shaft 23A is rigidly coupled to the rack type drive gear 55 which meshes with the pinion static gear 56.

Figure 16:
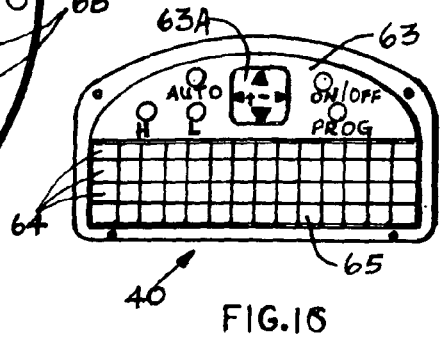
FIG. 16 is a possible configuration for the control panel for this invention, intended for explanatory purposes, but not limiting.

Now referring to FIG. 16, the control panel 40 depicts a sample button arrangement but possible button configuration for the control panel is legion and as such is not critical. However, switch panel 63A is used for increment or decrement. Buttons 63 are for programming the timer 62. Buttons 64 and 65 are for music reproduction and A/DC switches respectively.

Figure 17:
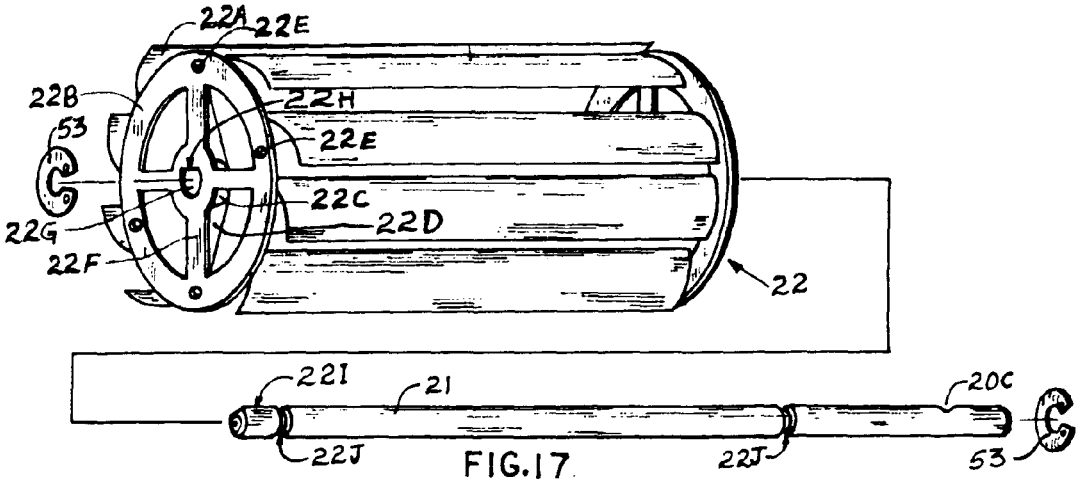
FIG. 17 is an exploded view of a cylindrical (centrifugal) fan assembly employed in this invention as another embodiment.

Referring now to FIG. 17, the fan assembly 22 depicts outwardly canted blades 22A integrally molded on either side of the radial edge flanges 22B provided each with centrally located D shaped holes 22G, which form into the inwardly extending short tubular stems 22C which integrally connects arms 22F via reinforcing flanges 22D. Several holes 22E equidistantly located on the radial edge flanges 22B serve to permit stacking of several fans 22, by means of rivets or bolts, thereby easily increasing length and rigidity without substantially increasing the unwanted oscillations inherent in long length cylindrical or centrifugal fans. The drive shaft 21 has a cross-section that matches and mates with the holes 22G on the fan 22 in such a manner that the grooves 22J on the shaft 21 accept C-Clips 53 in a rigid lock connection thereby preventing any play of the shaft in the axial direction. Radial motion of the shaft 21 is prevented by the flat side 22H of the holes 22G. A dimple 20C on the shaft 21 accepts a locking nut (FIG. 20) and keeps a drive pulley 20 from slipping.

Figure 18:
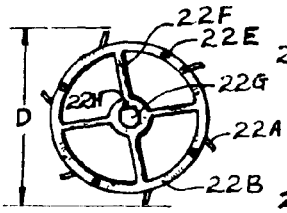
FIG. 18 is a top plan view of a fan assembly having outwardly canted blades.

In reference to FIG. 18, a fan assembly is depicted according to this invention, having outwardly canted blades 22A. Arms 22F connect outer edge flange 22B to inner flange having a D shaped hole 22G having at least one flat side 22H for accepting a matching drive shaft. 22E represents holes for rivets or bolts which permit the stacking of several fans. D is the true effective diameter of this fan configuration.

Figure 19:
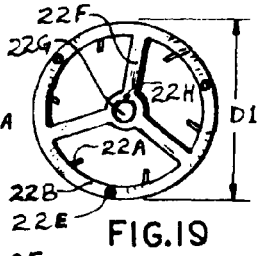
FIG. 19 is a top plan view of a fan assembly having inwardly canted blades.

In reference to FIG. 19, a fan assembly is depicted according to this invention, having inwardly canted blades 22A. Connecting arms 22F connect outer edge flange 22B to inner flange having shaped hole 22G having at least one flat side 22H for accepting a matching drive shaft. 22E represents holes for rivets or bolts which permit the stacking of several fans. D1 is the true effective diameter of this fan configuration. Diameters D1 and D should be equal if interchangeable and employed in the same system.

Figure 20:
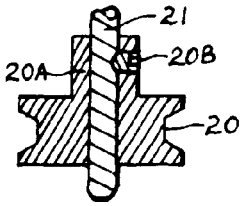
FIG. 20 is a sectional view of a pulley and fan shaft coupling method employing a locking nut.

Now referring to FIG. 20, a v-grooved pulley 20 is depicted. There is an integral raised stem 20A provided with a threaded hole for a locking set screw 2013 which engages a dimple on the shaft 21 and prevents the pulley from slipping. A well known conventional variable reluctance speed sensor system (not shown) attached to the fan shaft pulley may be used to detect a loose (slipping), worn or broken drive belt.

Figure 21:
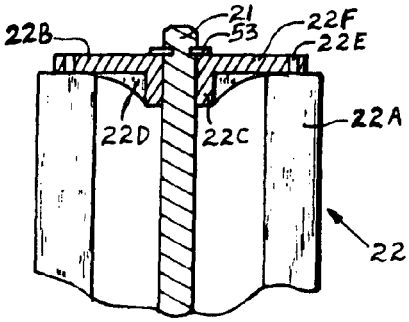
FIG. 21 is a partial cross-section of the fan arrangement shown in FIG. 17, assembled.

Now referring to FIG. 21, the fan blades are represented by 22A which is integrally molded with the outer edge flange 2213 and the centrally located tubular stub 22C which are connected to the arms 22F and strengthened by reinforcing flags 22D. The drive shaft 21 matches and rigidly mates with the centrally located holes formed by the tubes 22C and locked in place by a C-Clips 53 such that axial movements by the shaft 21 are negated. The fan assembly 22 depicted has an outwardly extended blade profile.

Figure 22:
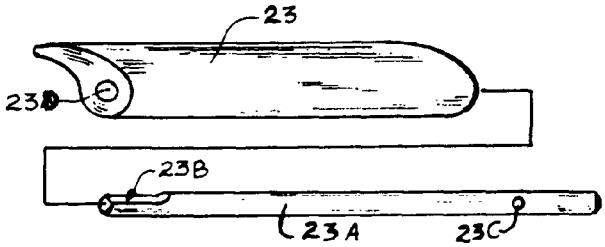
FIG. 22 is an exploded view of airfoil and its shaft employed in this invention to modify angle of attack.

In reference to FIG. 22, the depicted airfoil 23 which is of conventional design, is provided with a hole 23D which runs its length and permits a tight fit of the shaft 23A which is bonded thereon. One end of the shaft 23A is provided with a short flat side 23B which may also be threaded, for the purpose of accepting an adjusting knob. On the opposite end of the shaft 23A is positioned, a thru hole 23C for the purpose of accepting a spring loaded pin used to effect selectability of various angles of attack. Various NACA airfoils may be employed in this invention. It should be mentioned in passing that in fluid mechanics, it is a well known phenomena that all airfoil surfaces and particularly those employed in aircraft suffer some degree of loss of lift coefficient due to boundary layer separation on said surfaces. Elaborate boundary layer control techniques are usually employed to resolve these problems. This invention employs airfoils similar to aircraft types. In small systems, this problem may not be severe. However, in large systems, the same problems that affect airfoils in general when angles of attack become steep will come to bear and must be addressed in those situations. If the maximum selectable angle of attack is below about 17°, laminar flow or boundary layer separation (turbulent flow) problems may not occur to diminish performance of the system.

Figure 23:
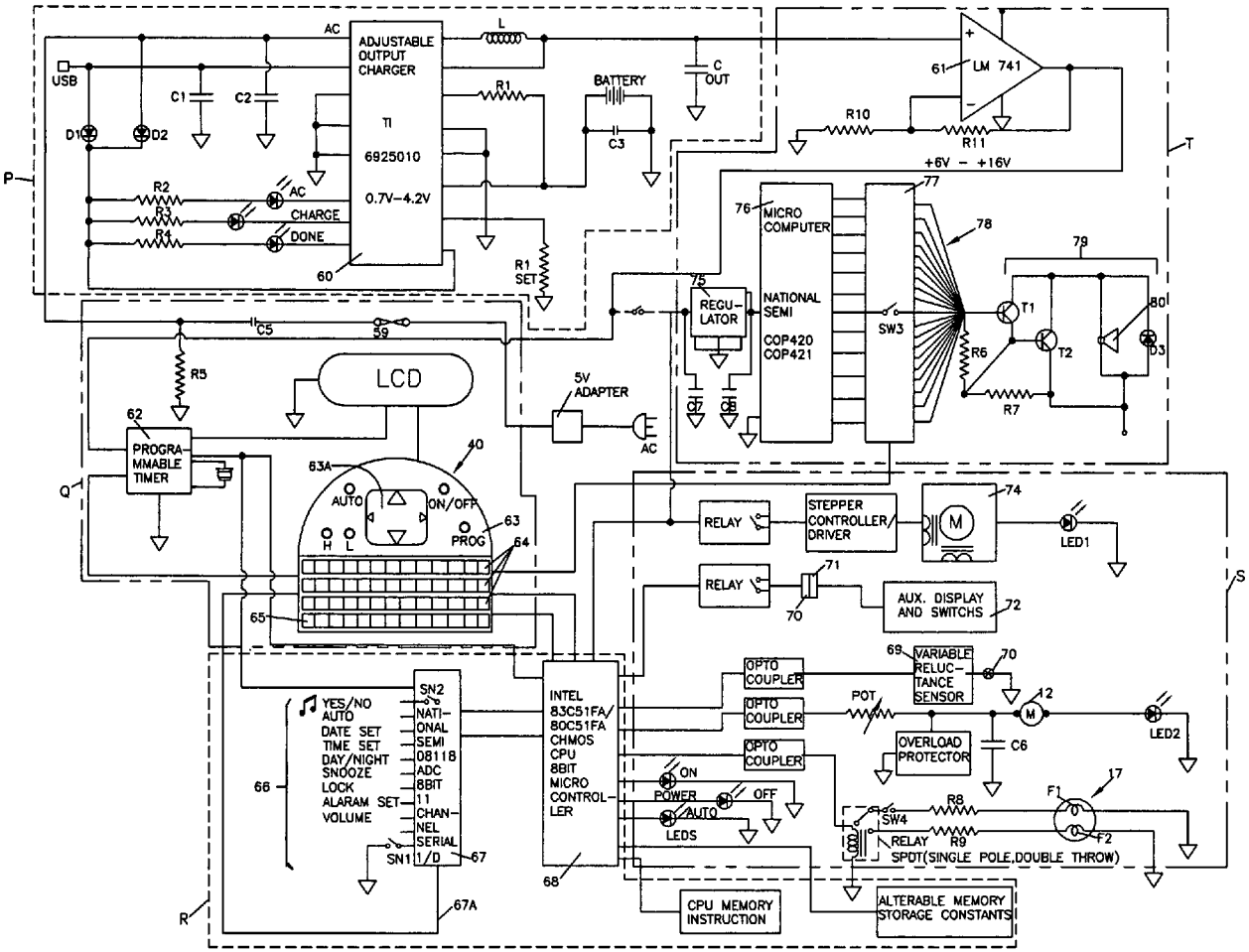
FIG. 23 is a schematic block diagram of the programmable electronic control circuit of the flag flying machine depicted in FIG. 1.

I now refer to FIG. 23 which is a programmable control circuit for the flag flying machine of FIG. 1. This circuit's emphasis is on the integration of a drive motor(s), a lighting system, a synthesized music reproducer, a rechargeable battery arrangement and a timing circuit, under the control of a CPU micro-controller, rather than emphasizing a flow chart instructional assembly.

Power from the standard AC outlet is stepped down to 5V from 115V or 220V. Power is transferred to a battery charging circuit P via capacitor C5 and resistor R5. The charging circuit P is driven by an adjustable output charging chip which is a Texas instrument BQ25010 having voltage range from 0.7V to 4.2V. 59 is an inline fuse. Though the battery charging circuit shown in P has been modified for this overall system, it is largely after Texas Instruments. Output capacitor C out inputs 4.2 volts into the non-inverting input of an op amp 61, an Intersil LM741 having a negative feedback loop in the traditional manner and employing resistors R10 and R11. Output voltages from about +6V to +16V are supplied to a programmable timer 62 which is preferably a National Semiconductor CD4541BC or a similar one of comparable performance. The programming circuit Q which includes said timer 62, a control panel 40 having programming switches (round buttons) 63, music selection switches 64 and control switches 65 (square buttons) coupled as shown to an LCD display. The programming circuit Q is connected to the control circuit R via an Analog to Digital Converter ADC 67 which is preferably a National Semiconductor 08118, 8 bit, 11 channel model with serial I/D. Via the wires 67A, the internal switches SW2 are brought to the control panel switch array 65. SWI is an ON/OFF switch while 66 represents the entire group of switches for the shown functions. The ADC 67 is connected to the central processing unit 68. The actuation switches SW2 for the functions represented by 66, as well as the ON/OFF switch SW1 are preferably brought to the control panel 40 at the lower row of buttons represented by 65, via wires 67A. CPU68 is preferably an Intel 83C51FA/80C51FA or 8XC51FX equivalent CHMOS, 8 bit micro-controller. Together, the ADC67 and the CPU68 constitute the control circuit R. They control the synthesized music circuit T as well as the controlled variables S, which include the fan motor 12, the stepper motor 74 (optional) for manipulating the airfoil, and a flag illuminating lamp 17. The CPU68 is also connected to the control panel 40. The stepper motor 74 is under the control of a relay and a controller/driver circuit 73 and has an LED1. An optional auxiliary display provided with switches 72 may be coupled to the CPU via couplers 70 and 71, and a relay. In another embodiment of this invention, a variable reluctance sensor 60 and a warning lamp 70 may be used to monitor fan shaft speed, for the purpose of determining belt slippage and/or wear. The sensor 60 may be coupled to the CPU68 via an optocoupler. The fan shaft drive motor 12 is coupled to the CPU via an optocoupler connected to a potentiometer used to manipulate motor speed. Power to the motor 12 arrives via a capacitor C6. There is an overload protection circuit and an LED2. The illuminating lamp 17 for the flag is under the control of a relay switch with a single pole, double throw (SPDT) and an ON/OFF switch SW4. The lamp 17 is preferably provided with two separate bulbs inside the lens housing and provided with the filaments F1 and F2. Power to the respective bulbs come via resistors R8 and R9 respectively. The arrangement is such that F1 may be turned on at any time by closing the switch SW4 while F2 comes on only when the relay energizes and connects the armature to the other contact. An optocoupler couples the lamp 17 to the CPU68. Power ON, OFF and AUTO LEDs are provided for display and are also connected to the CPU68. The CPU68 is provided with memory instructions as well as alterable memory storage constants.

The synthesized music circuit T is also under the control of the CPU68. It is provided with a micro-computer 76 having the desired music notes programmed in its memory. It is preferably a National Semiconductor model COP420/COP421. The micro computer 76 receives a 5 volt output from a constant voltage regulator 75 coupled to the CPU68. The regulator 75 is provided with capacitors C7 and C8. Any music tone programmed in the memory of the micro-computer 76 may be selected by using the switches SW3 on the switch console 77. However, these switches SW3 are preferably brought to the control panel 40 via wires 77A and are represented on the said control panel 40 by the group of switches 64. The wires 78 are configured in such a manner that their outputs are connected to an output circuit 79 employing a single loudspeaker 80. The output circuit 79 constitutes a high gain darlington pair T1 and T2 and coupling resistors R6 and R7 and a diode D3. The regulator 75 may be connected directly to the output from the operational amplifier 61. The regulator 75 is preferably an Analog Devices Model ADM663A/ADM666A. When a given type of musical note has been selected using the switches 64, the switch group 65 are used to select the variables represented by 66. The round button switches on the upper section 63 of the control panel U are used to digitally program the timer 62 such that selected variables are displayed on the LCD and the system is activated at a selected time. The four way switch 63A is used for increment or decrement. The programmable timer 62 is preferably a National Semiconductor Model CD4541BC. When the system activates at a selected time (clock alarm fashion), the fan motor 12 drives the fan which blows air over the flag, causing it to rise. At the same time, the relay turns on the lamp 17 and the selected music note begins to play through the loudspeaker 80. When the musical note which is programmed to play its entire length has finished playing, the CPU68 automatically shuts off the system unless repeat is selected during the programming process.

Figure 24:
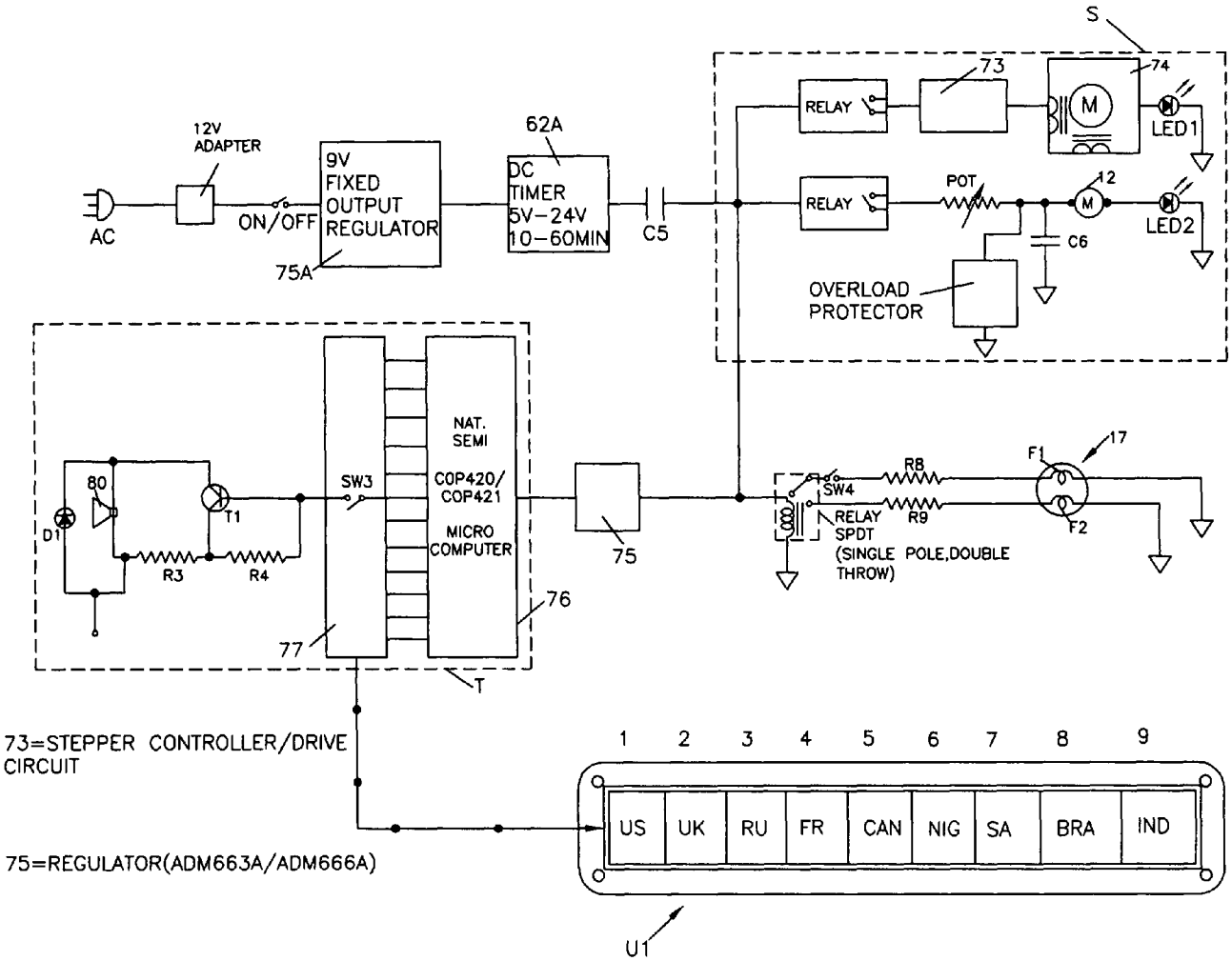
FIG. 24 is a schematic block diagram of another embodiment of this invention depicting a non-programmable control circuit of the flag flying machine shown in FIG. 1.

Referring now to FIG. 24 which is a non-programmable control circuit, an AC or battery power may be used to drive the fan motor 12 and the micro-controller 76. As is shown, an adapter steps down the mains AC voltage to about 12 volts which is then supplied to a solid state timer 62A via a fixed voltage regulator 75A with a 9V output. The various commercially available models is legion. The timer 62A which has a voltage range of 5 volts/6 volts DC has a selectable range of 6 minutes to 60 minutes. It is an Omron H3FA-SBU. The timer's output is stored by the capacitor C5 and supplied simultaneously to the fan motor 12, the stepper motor 74 (if employed), the illumination lamp 17 and the synthesized music circuit T. The stepper's circuit consists of a relay, a controller/drive circuit 73 and an LED1. The fan motor's circuit consists of a relay, a potentiometer, an overload protection circuit, a capacitor C6 and an LED2. Together, the two motor circuits constitute the flag actuating circuit S. The lamp 17 as aforementioned is preferably a two bulb arrangement inside a lens but is not restricted to this configuration. The lamp 17 is under the control of a relay switch with a single pole, double throw (SPDT) and an ON/OFF switch SW4. The respective bulbs have filaments F1 and F2. Power to the respective bulbs come via resistors R8 and R9 respectively. The arrangement is such that F1 may be turned on at any time by closing the switch SW4 while F2 comes on only when the relay energizes and connects the armature to the other contact. Power to the micro-computer 76 of the synthesized music circuit T comes from a fixed voltage regulator 75 which supplies a 5V output to the micro-computer 76, which is preferably a National Semiconductor Model COP420/COP421 or equivalent. The regulator 75 is preferably, an Analog Devices Model ADM663A/ADM666A. The output channels of 76 connected to the output transistor T, resistors R3 and R4 and diode D1 such as to permit only one speaker to be used to reproduce a selected musical note by depressing the switches SW3 on the console 77. The said switches SW3 are preferably brought to a switch panel U1 mounted on the machine via wires 77A. In operation, when the unit is plugged into the AC outlet and one of the button type switches on the switch panel U1 is depressed to select a musical note programmed into the memory of the micro-controller (eg. #1 may be US Star Spangled Banner), and the timer 62A has been set to say 60 minutes, then when ON/OFF switch is closed, the motor 12 will run and drive the fan which blows air over the flag, causing it to rise. The music comes on and plays in its entirety and the timer 62A shuts off the system. After 60 minutes or whatever time was preset, the system will activate again and repeat. If no music button is depressed in either circuit configuration, the flag will still be made to fly but without the benefit of a musical note activating as well. This feature may aide in the conservation of power. Individuals skilled in electronic control circuits and systems may find it necessary to improve on or modify the circuits thus described and depicted in FIGS. 23 and 24 without deviating from or defeating the basic concepts of this invention.

I claim:

1. A machine for controllably flying a flag in the absence of the natural wind, comprising:

a long cylindrical centrifugal fan and shaft assembly driven by a motor mounted inside a housing of a base unit by means of pulleys and a serpentine belt;

a tubular windpipe attached to the base unit and surrounding the fan and shaft assembly, an airfoil, and a flag pole, wherein a shaft of the fan and shaft assembly is rotatably supported by bearings;

wherein the airfoil is positioned between a fan of the fan and shaft assembly and the flag pole and has an adjustable angle of attack, altering air blowing past it and thereby permitting the controlled manipulation of the attitude of a flag mounted on the flag pole.

2. The machine for controllably flying a flag in the absence of natural wind according to claim 1, further comprising a non-programmable solid state output timer that controls flying of a flag in the absence of natural wind.

3. A machine for controllably flying a flag in the absence of natural wind according to claim 1, wherein the machine is capable of indoor or outdoor use.

4. A machine for controllably flying a flag in the absence of natural wind according to claim 1, further comprising a base mounted stepper motor configured to change the angle of attack of the airfoil.

5. A machine for controllably flying a flag in the absence of natural wind according to claim 1, further comprising bevel gears, wherein the fan and shaft assembly is driven directly by the motor by means of the bevel gears.

6. A machine for controllably flying a flag in the absence of natural wind according to claim 1, further comprising a knob coupled to a shaft of the airfoil for changing the airfoil's angle of attack, wherein the airfoil is held in a selected position by a retaining pin under spring tension and a tensioner body having selector position grooves.

7. A machine for controllably flying a flag in the absence of natural wind according to claim 1, further comprising a base-mounted hand crank configured to change the angle of attack of the airfoil.

8. A machine for controllably flying a flag in the absence of natural wind having a drive belt according to claim 1, wherein said serpentine belt is surrounded by protective raised flange walls, whereby in the event of a catastrophic belt break, damage to surrounding components is minimized.

9. A machine for controllably flying a flag in the absence of natural wind according to claim 1, further comprising control panel and an LCD display mounted in the base unit for selecting songs as well as programming flying of the flag.

10. A machine for controllably flying a flag in the absence of natural wind according to claim 1, wherein said fan has inwardly or outwardly canted blades.

11. A machine for controllably flying a flag in the absence of natural wind according to claim 1, wherein said airfoil shape is a NACA airfoil.

12. A machine for controllably flying a flag in the absence of natural wind according to claim 1, further comprising a variable reluctance sensor configured to monitor the fan's speed as a means for determining belt slippage or damage.

13. A machine for controllably flying a flag in the absence of natural wind according to claim 1, wherein the bearings are nylon sleeve bearings and/or ball bearings.

14. A machine for controllably flying a flag in the absence of natural wind according to claim 1, wherein the wind pipe is shaped to create a throat and mouth arrangement around the airfoil, such that the airfoil behaves like a movable phase plug within said mouth, thereby enhancing the efficiency of the air blown over the flag.

15. The machine of claim 1, wherein the flag is mounted edgewise on the flag pole and the flag pole is removable.

16. The machine of claim 1, further comprising holes on the windpipe opposite the flagpole through which air can be drawn in by the fan.

17. The machine of claim 1, further comprising an adjusting knob placed atop a top cover of the windpipe, wherein the adjusting knob is configured to change the angle of attack of the airfoil, whereby the flag's attitude blown air may be altered at will.

18. The machine of claim 1, further comprising an illuminating lamp mounted atop the base unit and configured to illuminate the flag.

19. The machine of claim 1, further comprising a synthesized music circuit comprising several songs programmed in its memory and looped together with a programmable timer and an LCD display and a control panel configured for timed actuation of the machine.

* * * * *